US012311217B2

(12) United States Patent
Yoo

(10) Patent No.: US 12,311,217 B2
(45) Date of Patent: May 27, 2025

(54) SQUAT MACHINE

(71) Applicant: DRAX INC., Gyeonggi-do (KR)

(72) Inventor: Seon Kyung Yoo, Seoul (KR)

(73) Assignee: DRAX INC., Gyeonggi-do (KR)

( * ) Notice: Subject to any disclaimer, the term of this patent is extended or adjusted under 35 U.S.C. 154(b) by 216 days.

(21) Appl. No.: 18/037,763

(22) PCT Filed: Nov. 19, 2021

(86) PCT No.: PCT/KR2021/017075
§ 371 (c)(1),
(2) Date: May 18, 2023

(87) PCT Pub. No.: WO2022/108384
PCT Pub. Date: May 27, 2022

(65) Prior Publication Data

US 2023/0405386 A1 Dec. 21, 2023

(30) Foreign Application Priority Data

Nov. 19, 2020 (KR) ..... 10-2020-0155721
May 26, 2021 (KR) ..... 10-2021-0067901

(51) Int. Cl.
*A63B 21/06* (2006.01)
*A63B 21/00* (2006.01)
(Continued)

(52) U.S. Cl.
CPC ..... *A63B 21/0615* (2013.01); *A63B 21/0626* (2015.10); *A63B 21/154* (2013.01);
(Continued)

(58) Field of Classification Search
CPC ..... A63B 21/0615; A63B 21/0626; A63B 21/154; A63B 21/4034; A63B 21/4035;
(Continued)

(56) References Cited

U.S. PATENT DOCUMENTS 5,472,397 A * 12/1995 Ammoscato ..... A63B 21/078 482/104
5,628,715 A 5/1997 Simonson
(Continued)

FOREIGN PATENT DOCUMENTS

CN 105771184 10/2017
CN 108283791 7/2018
(Continued)

OTHER PUBLICATIONS

"Search Report of Europe Counterpart Application", issued on Sep. 10, 2024, p. 1-p. 8.

*Primary Examiner* — Joshua Lee
(74) *Attorney, Agent, or Firm* — JCIPRNET

(57) ABSTRACT

A squat machine is disclosed. The disclosed squat machine includes: a base frame; an exercise member which is rotatable about a first axis with respect to the base frame and capable of supporting at least one weight member; a support member which is rotatable about a second axis, which is different from the first axis, with respect to the base frame, is located on a rotation path of the exercise member, and rotates between a first position at which the exercise member is supportable and a second position out of the rotation path of the exercise member; a handle member which is formed on the exercise member to rotate about a third axis, which is different from the first axis and the second axis, so that the support member is rotated to the first position; a connection wire connecting the support member to the handle member; and a pulley guiding movement of the connection wire.

15 Claims, 17 Drawing Sheets

(51) Int. Cl.
*A63B 21/062* (2006.01)
*A63B 23/04* (2006.01)
*A63B 71/00* (2006.01)

(52) U.S. Cl.
CPC ..... *A63B 21/4034* (2015.10); *A63B 21/4035* (2015.10); *A63B 21/4039* (2015.10); *A63B 2023/0411* (2013.01); *A63B 2071/0072* (2013.01)

(58) Field of Classification Search
CPC ..... A63B 21/4039; A63B 23/0405; A63B 2023/0411; A63B 2071/0063; A63B 2071/0072; A63B 2071/0081; A63B 2208/0223
See application file for complete search history.

(56) References Cited

U.S. PATENT DOCUMENTS

| | | | | |
|---|---|---|---|---|
| 6,251,052 | B1 | 6/2001 | Simonson | |
| 7,029,426 | B1 | 4/2006 | Fuller, Sr. | |
| 7,226,400 | B1 * | 6/2007 | Gedeon-Janvier | A63B 21/4031 482/106 |
| 10,343,008 | B2 * | 7/2019 | Pullins | A63B 23/03525 |
| 10,850,152 | B2 * | 12/2020 | Kelly | A63B 21/4041 |
| 2016/0346586 | A1 | 12/2016 | Pullins et al. | |
| 2018/0104526 | A1 | 4/2018 | Kelly | |

FOREIGN PATENT DOCUMENTS

| | | |
|---|---|---|
| CN | 108785995 | 11/2018 |
| WO | 0119460 | 3/2001 |

* cited by examiner

SQUAT MACHINE

TECHNICAL FIELD

The present disclosure relates to a squat machine.

BACKGROUND ART

In accordance with increased quality of life, the interest of people in health is increasing, and numerous people are using various forms of weight exercise equipment to improve their physical strength.

Weight exercise equipment is provided in various forms according to the body part or purpose of use, to increase muscle strength. For example, in order to increase the muscle strength of the lower body of a user, there is a squat machine that allows the user to perform a squat exercise.

A general squat exercise strengthens the strength of the lower body by the user repeatedly sitting down and standing up while lifting a barbell or a dumbbell. However, the squat exercise using a barbell or a dumbbell may cause injury when the user loses its center of gravity.

In consideration of this point, recently, a squat machine capable of preventing injury of a user and having a practical squat exercise effect is being developed.

The squat machine may include a base frame, an exercise member which is rotatable with respect to the base frame and capable of supporting a weight member, and a support member capable of moving and supporting the exercise member.

DISCLOSURE

Technical Problem

The present disclosure provides a squat machine capable of easily manipulating a support member and minimizing the movement of the support member during an exercise, and a method of using the squat machine.

Technical Solution

According to an embodiment, a squat machine includes a base frame, an exercise member which is rotatable about a first axis with respect to the base frame and supportable at least one weight member, a support member which is rotatable about a second axis, which is different from the first axis, with respect to the base frame and rotates between a first position located on a rotation path of the exercise member at which the exercise member is supportable and a second position out of the rotation path of the exercise member, a handle member which is formed on the exercise member to rotate about a third axis, which is different from the first axis and the second axis, so that the support member is rotated to the first position, a connection wire connecting the support member to the handle member, and a pulley guiding movement of the connection wire.

The pulley may be disposed on the base frame such that the support member is maintained at the second position when the exercise member rotates with respect to the base frame.

Rotation of the handle member may be limited to within 20% of a rotatable range when the exercise member rotates with respect to the base frame while the support member is located at the second position.

The pulley may include a contact part contacting the connection wire and wing parts disposed on both sides of the contact part and preventing shaking of the connection wire, and a distance between a rotation center of the pulley and a center of the first axis may be greater than 1 time and less than 1.5 times a sum of a radius of each of the wing parts and a radius of the first axis.

A length of the connection wire wound around the pulley may change when the exercise member rotates with respect to the base frame, and a position of the pulley with respect to the base frame may be determined in consideration of a change in the length of the connection wire wound around the pulley.

The third axis of the handle member may move with respect to the first axis when the exercise member rotates with respect to the base frame, and a distance from the pulley to the handle member may change while the third axis moves.

The exercise member may include shoulder support portions configured to contact user's shoulders, and the handle member may be disposed adjacent to each of the shoulder support portions.

A shortest distance between the handle member and each of the shoulder support portions may be within 20 cm.

The support member may be disposed lower than the exercise member when the support member is at the first position.

The support member may include a first support portion supporting the exercise member at a first height and a second support portion supporting the exercise member at a second height lower than the first height.

The support member may include a safety stopper supporting the exercise member to prevent the exercise member from directly contacting the floor at the second position.

The support member may be configured to move from the first position to the second position by gravity.

The support member may further include a weight portion providing a load to move from the first position to the second position.

The squat machine may further include a bias member disposed on at least one end of the connection wire and providing a bias pulling the connection wire in one direction.

The bias member may include a fixing portion fixed to an end of the connection wire, a connection housing connecting the connection wire to the support member or the handle member, and an elastic member providing an elastic force to move the fixing portion away from the connection housing.

Other aspects, features and advantages than those described above will become apparent from the following drawings, the claims and the detailed description of the disclosure.

These general and specific aspects may be implemented by using a system, a method, a computer program, or a combination thereof.

Advantageous Effects

According to the squat machine and the method of using the squat machine according to an embodiment of the present disclosure, it is possible to easily manipulate the support member and minimize the movement of the support member during an exercise.

MODE FOR INVENTION

Figure 1A:
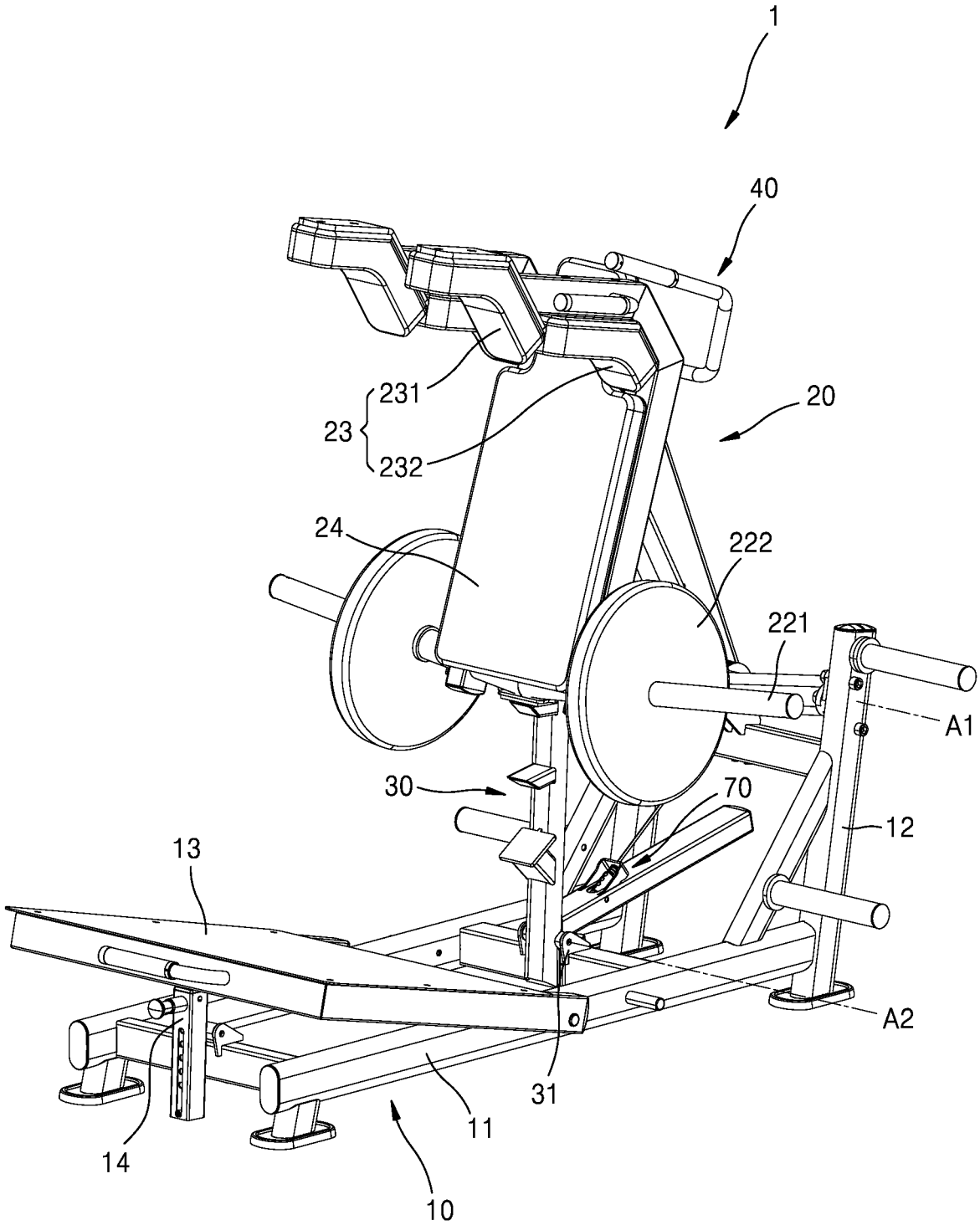
FIGS. 1A and 1B are perspective views for explaining a squat machine according to an embodiment.

Hereinafter, embodiments of the present disclosure will be described in detail with reference to the accompanying drawings. In the drawings, like reference numerals denote like components, and the size or thickness of each component may be exaggerated for clarity of explanation.

Figure 1B:
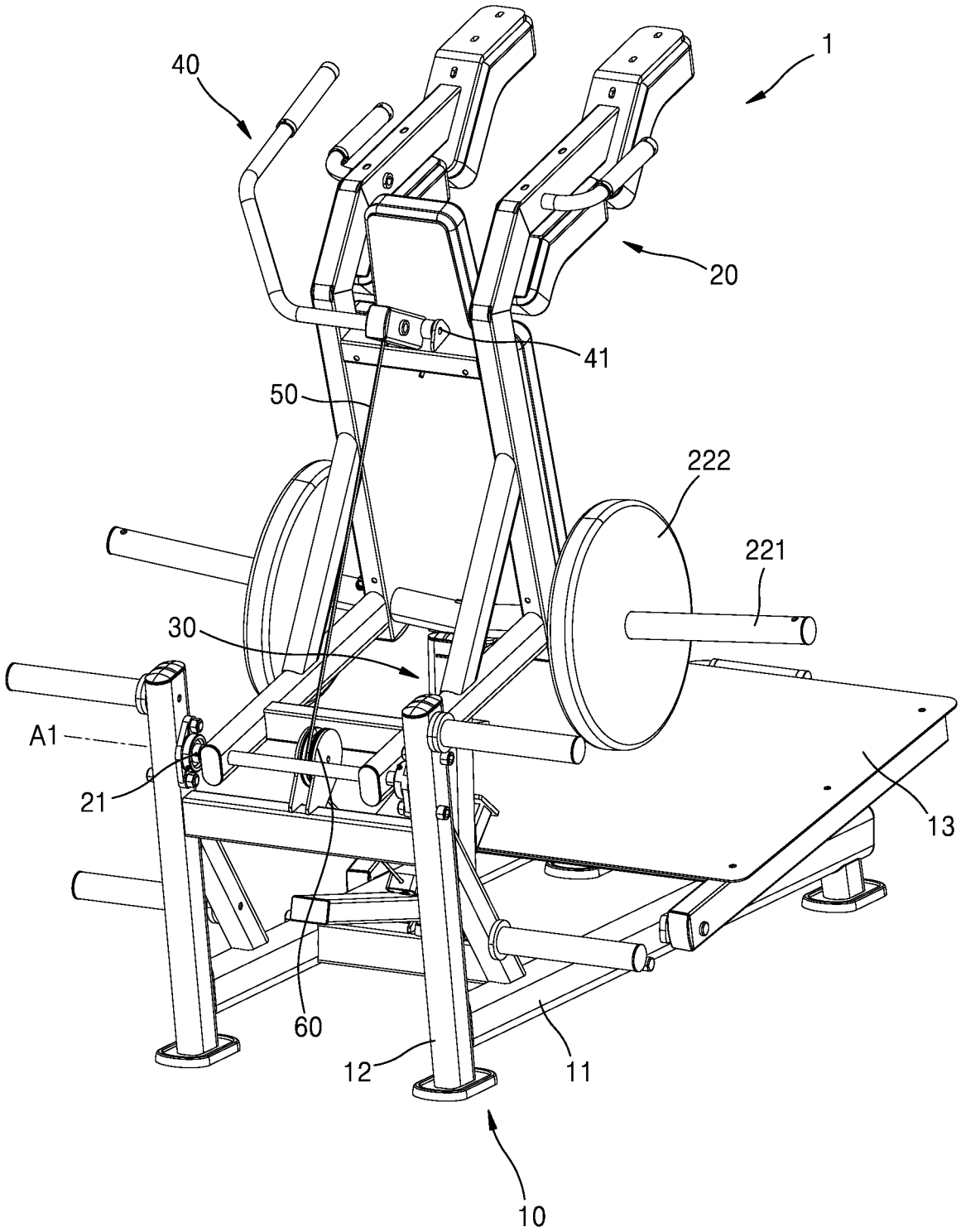
Figure 2:
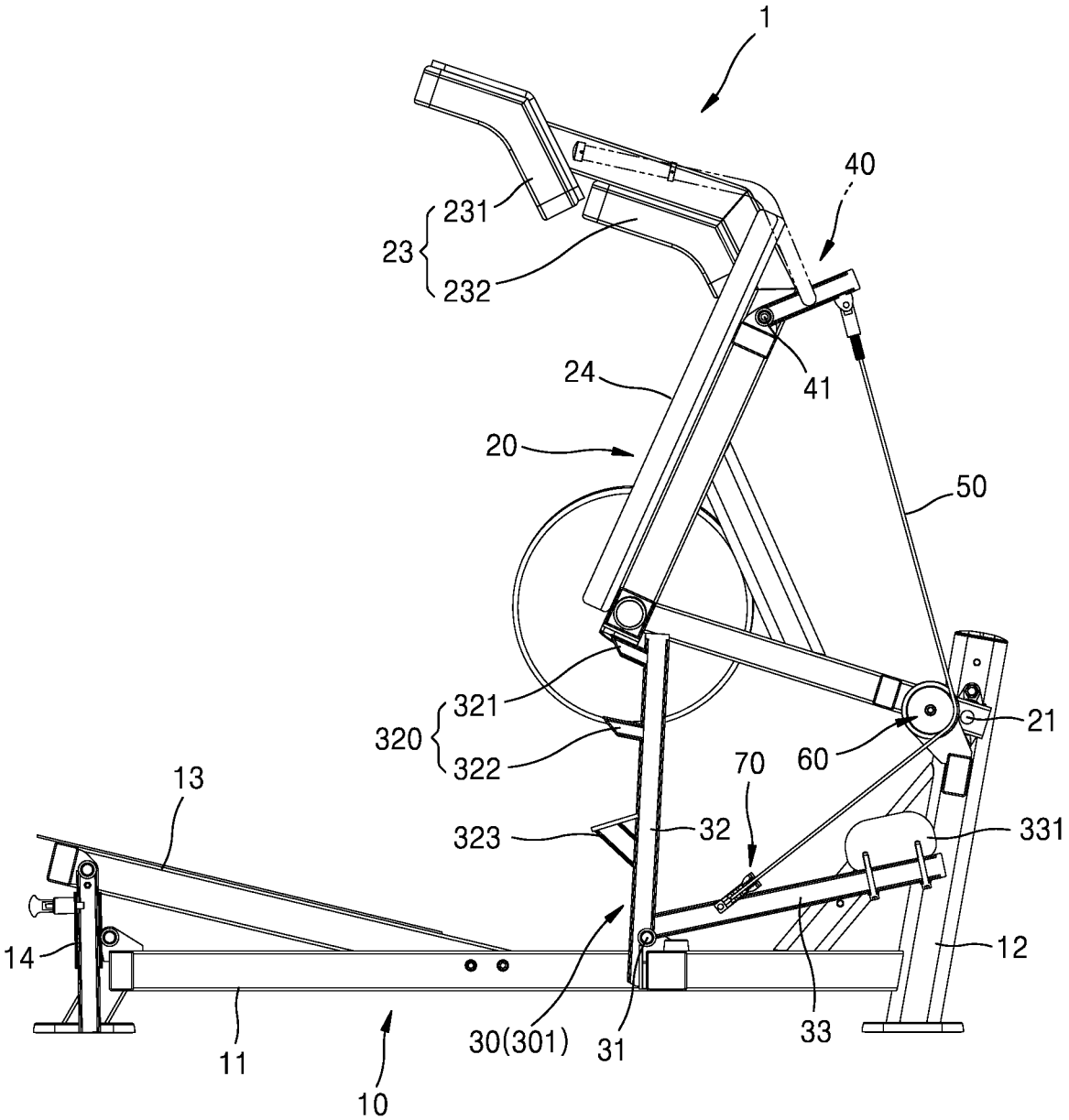
FIG. 2 is a cross-sectional view of the squat machine of FIG. 1.

FIGS. 1A and 1B are perspective views for explaining a squat machine 1 according to an embodiment. FIG. 2 is a cross-sectional view of the squat machine 1 of FIG. 1. FIGS. 3 to 6 are cross-sectional views of the squat machine 1 according to an embodiment, and are views for explaining a state of use of the squat machine 1.

Referring to FIGS. 1A, 1B, and 2, the squat machine 1 according to an embodiment includes a base frame 10, an exercise member 20, a support member 30, and a handle member 40.

The base frame 10 is disposed on a bottom surface and rotatably supports the exercise member 20. The base frame 10 may include a first frame 11 disposed on the bottom surface and a second frame 12 disposed at a certain angle from the first frame 11. The exercise member 20 may be installed on the second frame 12. An angle between the second frame 12 and the first frame 11 may be 45° to 135° or 90° to 135°.

The first frame 11 may include a plate 13 supporting user's feet during an exercise. The plate 13 may be connected to an adjusting unit 14 capable of adjusting at least one of a height and an inclination. However, since the plate 13 and the adjusting unit 14 are optional components, the plate 13 and the adjusting unit 14 may be omitted if necessary.

The exercise member 20 has a structure capable of rotating about a first axis 21 with respect to the base frame 10. The first axis 21 may be located at a certain height from the bottom surface. For example, the first axis 21 may be located at a height of 30 cm to 100 cm from the bottom surface. The first axis 21 may be installed on the second frame 12.

The exercise member 20 includes a pair of support bars 221 capable of supporting at least one weight member 222. A user may set the exercise member 20 to a desired weight by inserting a desired number of weight members 222 into the support bars 221.

The exercise member 20 includes a pair of shoulder support portions 23 configured to contact user's shoulders and a back stand portion 24 supporting the user's back. The shoulder support portions 23 include a first support part 231 supporting the shoulder when the user exercises in a first posture facing the exercise member 20 and a second support part 232 supporting the shoulder when the user exercises in a second posture facing the opposite direction to the first posture.

The shoulder support portions 23 and the back stand portion 24 may be disposed at a certain angle, for example, 60° to 120° or 80° to 100°.

The user may perform a squat exercise while standing on the plate 13 and supporting the shoulder on the shoulder support portions 23.

The support member 30 is rotatable about the second axis 31 with respect to the base frame 10. The second axis 31 may be installed on the first frame 11. The second axis 31 is a different axis from the first axis 21. A rotation center A2 of the second axis 31 may be parallel to the rotation center A1 of the first axis 21, but may be disposed at a position lower than that of the rotation center A1 of the first axis 21.

The support member 30 may selectively support the exercise member 20. For example, the support member 30 may support the exercise member 20 so as to limit the lowering of the exercise member 20 when the user ends or stops the exercise, but may be out of a rotation path of the exercise member 20 so as not to limit the rotation of the exercise member 20 when the user is exercising.

The support member 30 may rotate between a first position 301 located on the rotation path of the exercise member 20 at which the exercise member 20 is supportable and a second position 302 out of the rotation path of the exercise member 20.

Accordingly, when the support member 30 is at the first position 301, the exercise member 20 is supported by the support member 30, so that the exercise member 20 does not descend below a certain height. Accordingly, the user may take a break or end an exercise and leave the squat machine 1 while the exercise member 20 is supported on the support member 30.

Figure 3:
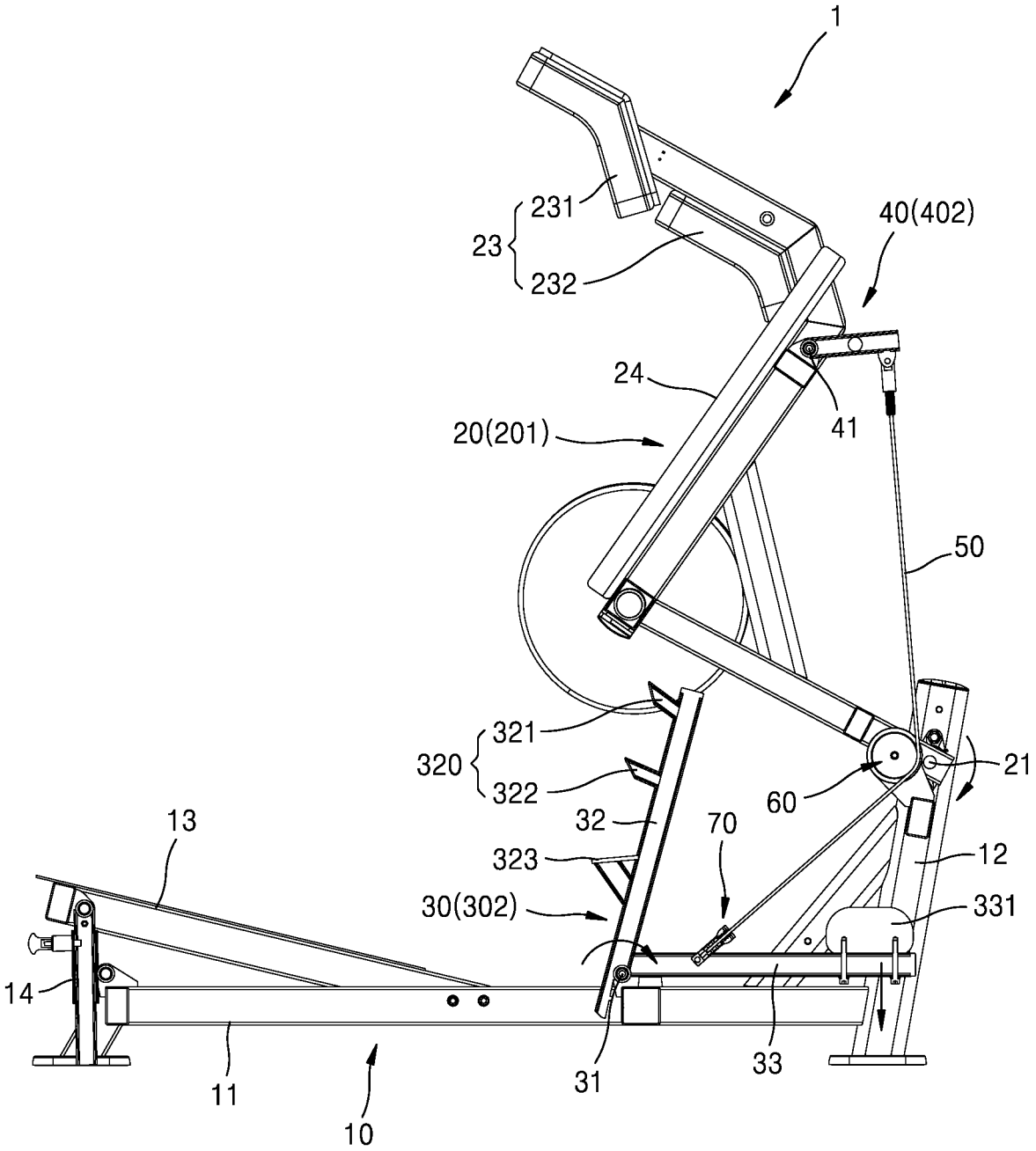
FIGS. 3 to 6 are cross-sectional views of a squat machine according to an embodiment, and are views for explaining a state of use of the squat machine.
Figure 4:
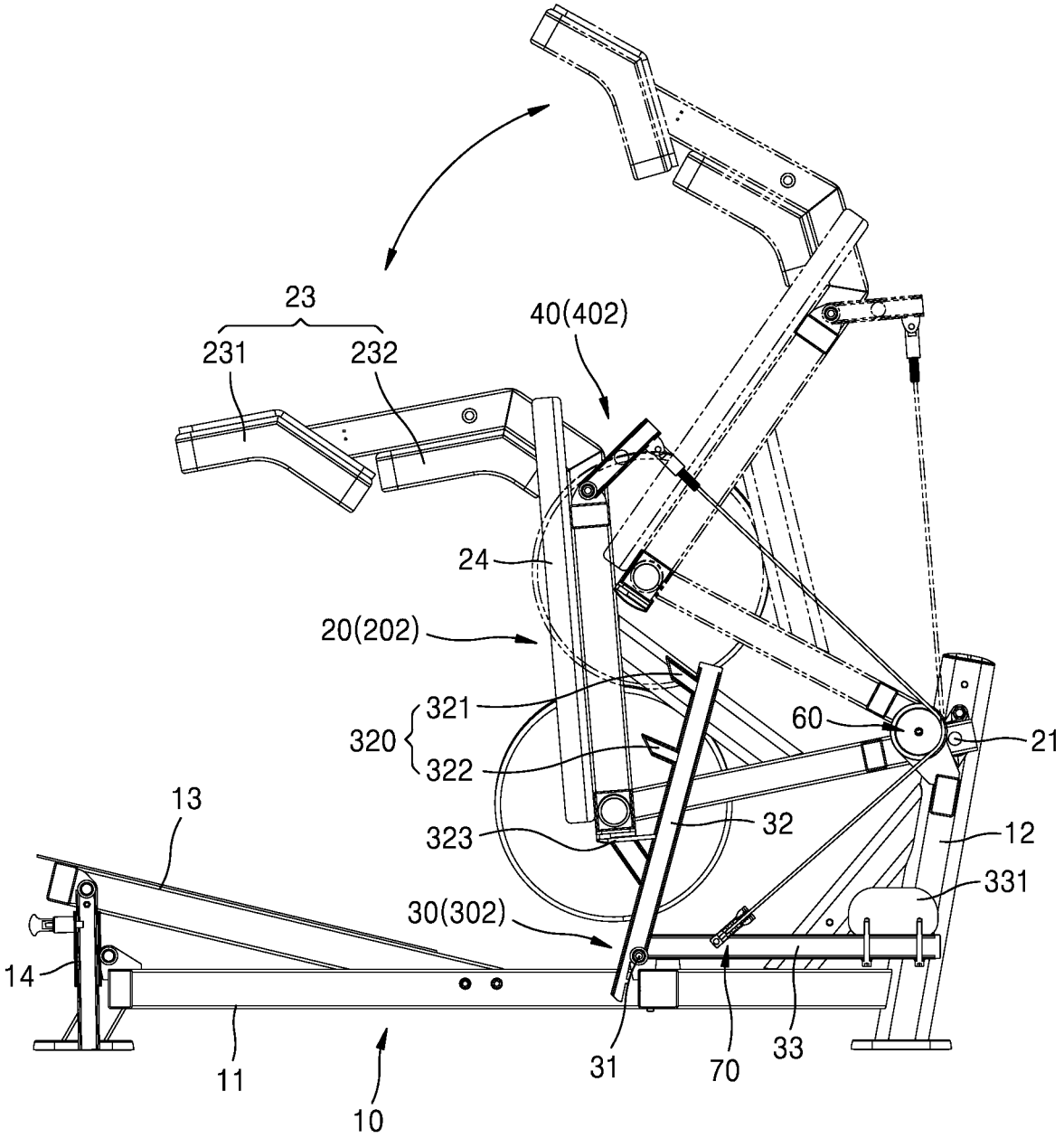
Figure 5:
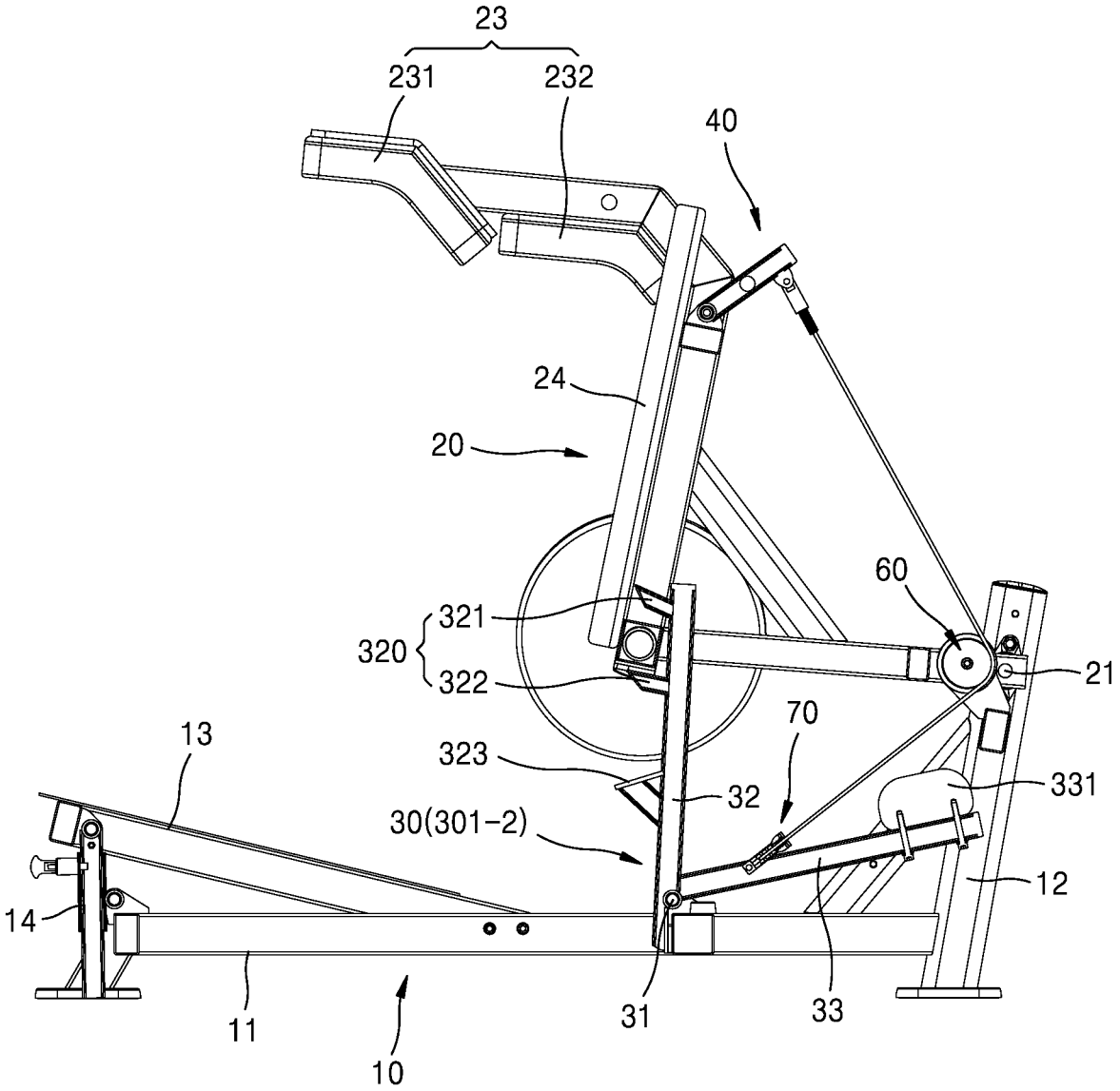

Referring to FIGS. 3 and 4, when the support member 30 is at the second position 302, since the support member 30 is at a position out of the rotation path of the exercise member 20, the rotation of the exercise member 20 is not limited by the support member 30. Accordingly, the user may lift or lower the exercise member 20 without interference by the support member 30.

Referring to FIGS. 2 to 6, the support member 30 may include a plurality of support portions 320 supporting the exercise member 20 at the first position 301. For example, the support member 30 may include a first support portion 321 supporting the exercise member 20 at a first height and a second support portion 322 supporting the exercise member 20 at a second height lower than the first height. The first position 301 may be a plurality of positions. For example, the first position 301 may include a 1-1th position 301 in which the exercise member 20 is in contact with and supported by the first support portion 321, and a 1-2th position 301-2 in which the exercise member 20 is in contact with and supported by the second support portion 322.

The support member 30 may be configured to move from the first position 301 to the second position 302 by gravity. The support member 30 includes a first part 32 in which the support portion 320 is installed and a second part 33 providing a rotating force in a specified direction when no external force acts on the first part 32. The second part 33 of the support member 30 may further include a weight portion 331 providing a load so that the support member 30 moves from the first position 301 to the second position 302.

Referring back to FIG. 3, as the user lifts the exercise member 20, a contact between the exercise member 20 and the support member 30 is released, and accordingly, the support member 30 rotates about the second axis 31 clockwise by the weight of the second part 33. Accordingly, the support portion 320 disposed on the first part 32 moves to a position that does not interfere with the rotation of the exercise member 20.

Figure 6:
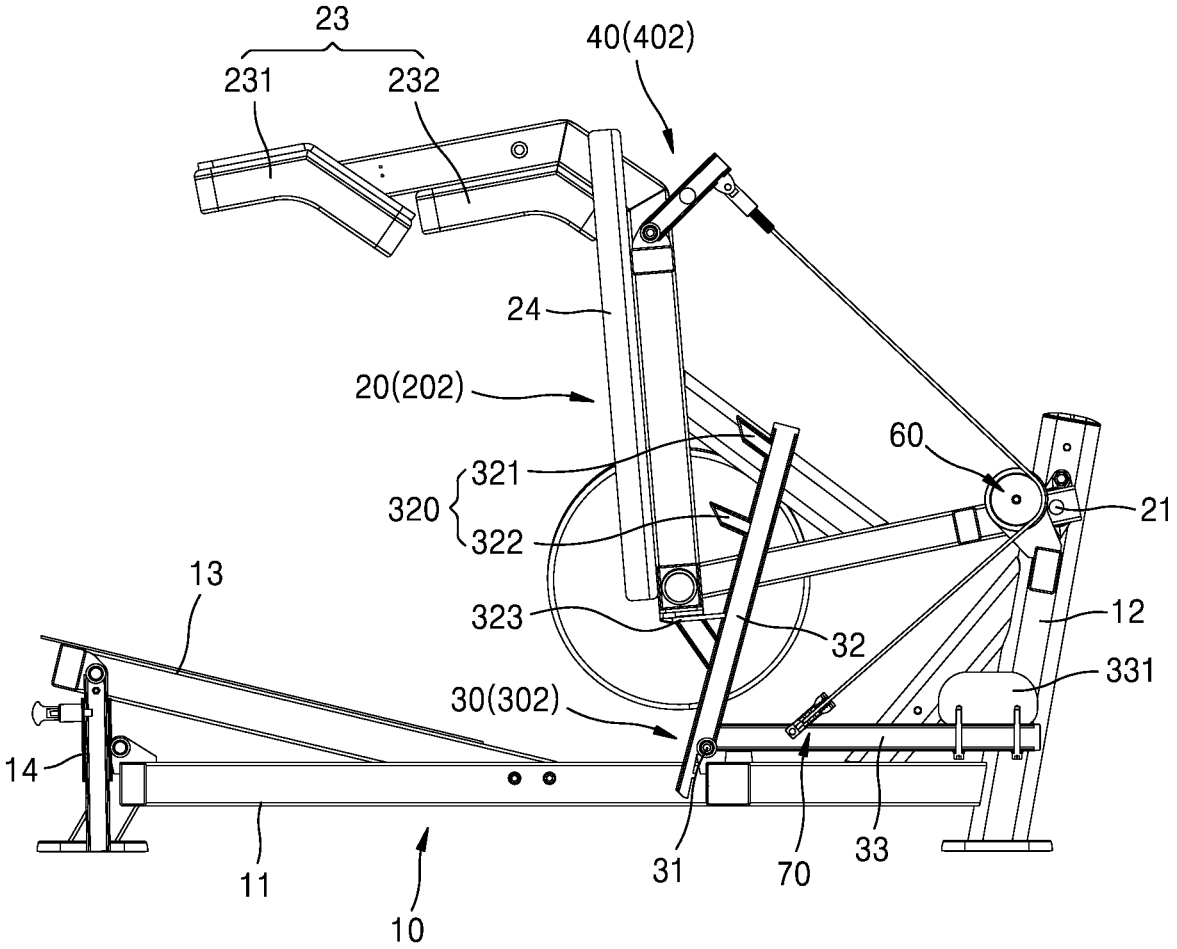

Referring to FIG. 6, the support member 30 may further include a safety stopper 323 disposed at a position lower than that of the second support portion 322. When the support member 30 is located at the second position 302, the first support portion 321 and the second support portion 322 of the support member 30 are at positions out of the rotation path of the exercise member 20, whereas, the safety stopper 323 is located in the rotation path of the exercise member 20. Accordingly, the safety stopper 323 may support the exercise member 20 to prevent the exercise member 20 from directly contacting the floor even when the support member 30 is located at the second position 302.

Figure 7:
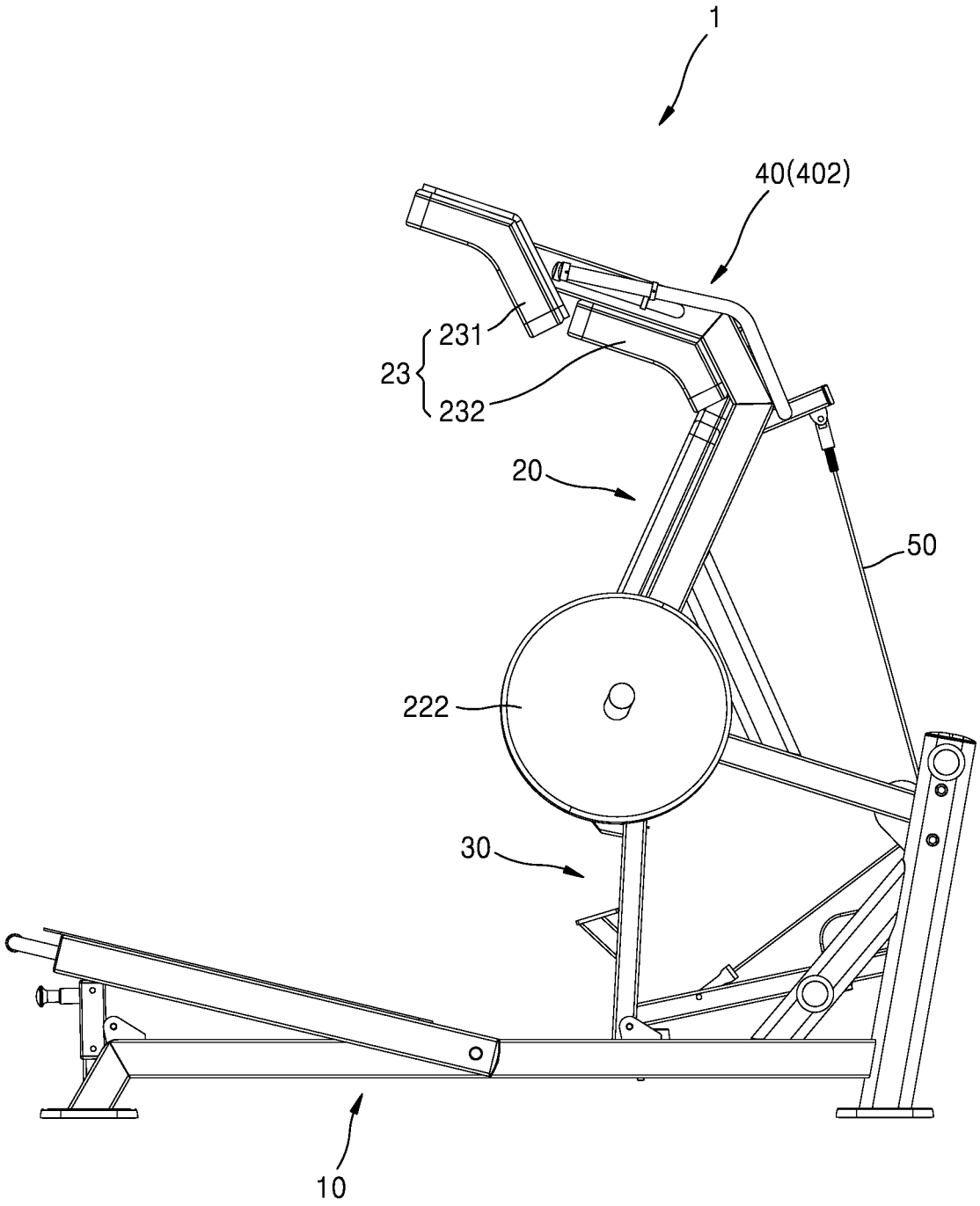
FIG. 7 is a side view of a squat machine according to an embodiment.
Figure 8A:
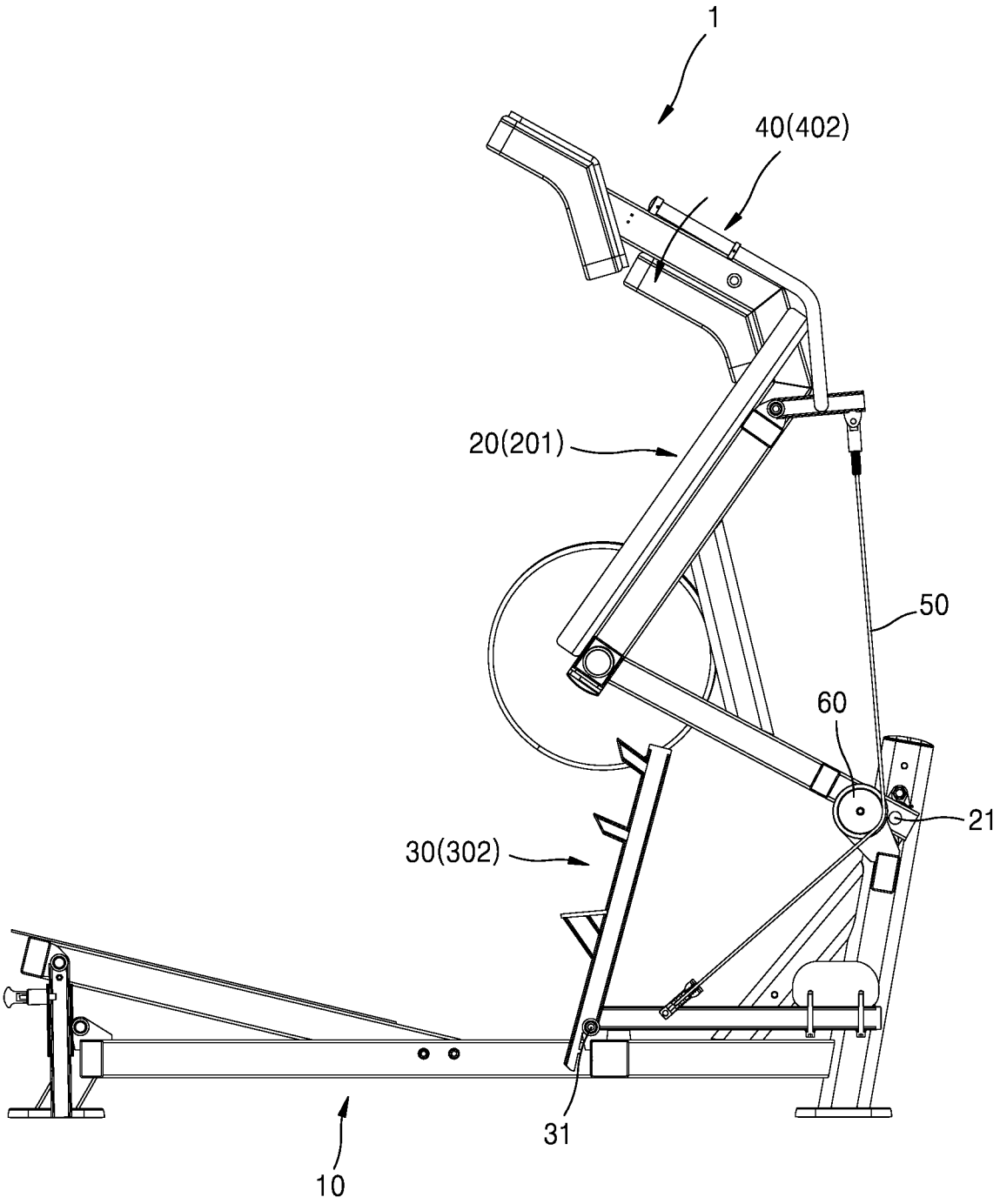
FIGS. 8A and 8B are views for explaining the rotation of a support member according to the rotation of a handle member of a squat machine according to an embodiment.
Figure 8B:
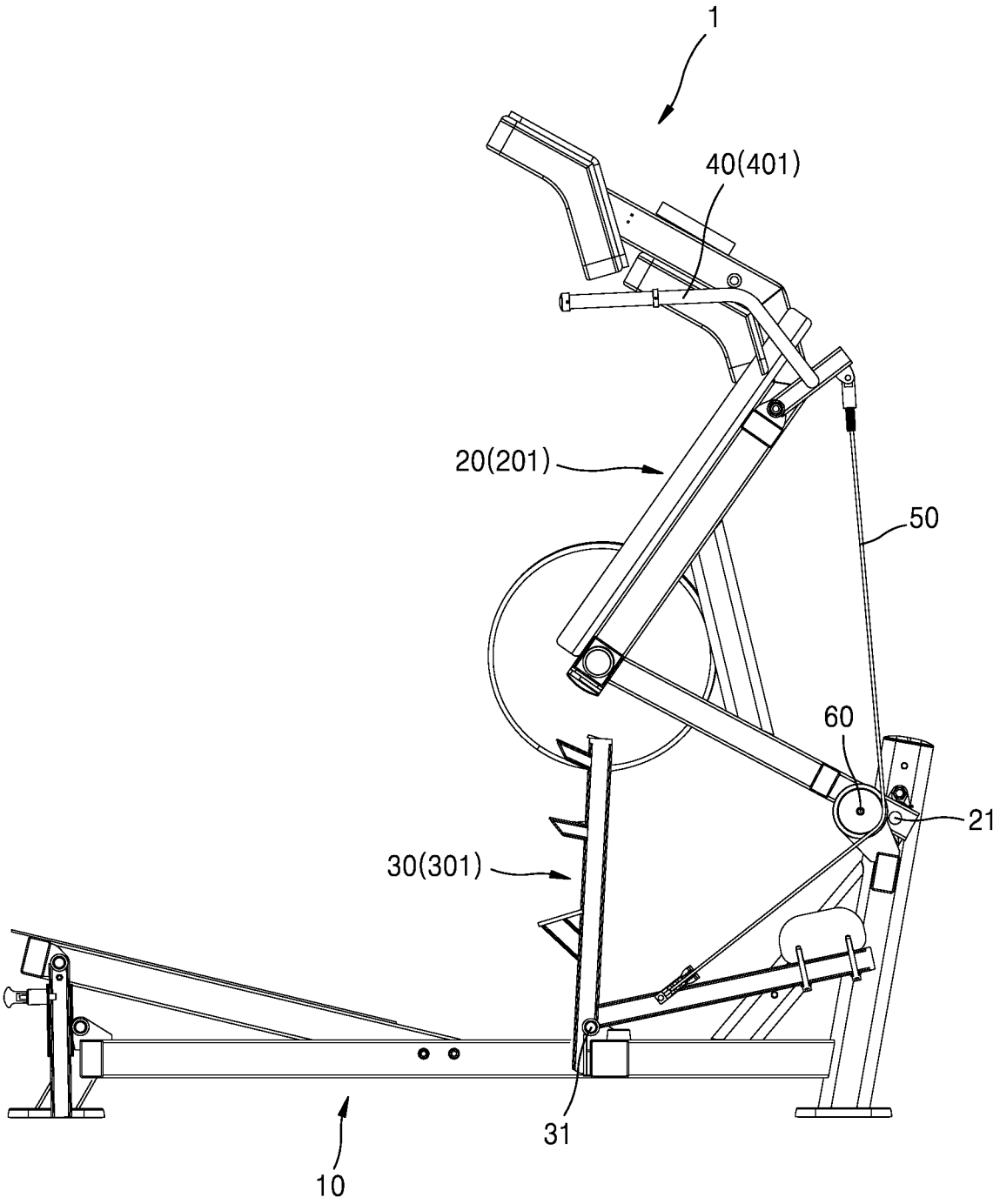

FIG. 7 is a side view of the squat machine 1 according to an embodiment. FIGS. 8A and 8B are views for explaining the rotation of the support member 30 according to the rotation of the handle member 40 of the squat machine 1 according to an embodiment.

Referring to FIGS. 1A, 1B and 7, the handle member 40 is a component manipulating the support member 30. The handle member 40 is configured to rotate about a third axis 41 with respect to the exercise member 20 so that the support member 30 is rotated to the first position 301. The third axis 41 is disposed on the exercise member 20. The handle member 40 may be disposed at a position adjacent to the user's shoulder, by installing the handle member 40 to the exercise member 20. The shortest distance between the handle member 40 and the shoulder support 23 may be within 20 cm.

The handle member 40 is disposed at the position adjacent to the user's shoulder, and thus, the user may manipulate the handle member 40 while performing a squat exercise without shaking the center of the lower body.

Referring to FIGS. 7, 8A and 8B, the handle member 40 may rotate between a third position 401 in which the support member 30 is located at the first position 301 and a fourth positions 402 in which the support member 30 is located at the second position 302.

When ending or temporarily stopping the exercise, the user may pull the handle member 40 and rotate the handle member 40 to the third position 401 so that the support member 30 may be located at the first position 301.

The user may easily check the position movement of the support member 30 disposed below the exercise member 20 with the naked eye while manipulating the handle member 40 using his/her hand, thereby easily supporting the exercise member 20 on the support member 30.

The connection wire 50 is disposed between the support member 30 and the handle member 40, and transmits a force applied to the handle member 40 by the user to the support member 30. The connection wire 50 has a certain length.

The pulley 60 guides the movement of the connection wire 50. The direction of the connection wire 50 may be changed by the pulley 60. The direction of the connection wire 50 connected to the handle member 40 and the direction of the connection wire 50 connected to the support member 30 may be changed by the pulley 60.

When the user moves the handle member 40 from the fourth position 402 to the third position 401, the force applied by the user is transmitted to the support member 30 through the connection wire 50, and the support member 30 moves from the second position 302 to the first position 301.

When the user lifts the exercise member 20 without manipulating the handle member 40, the support member 30 rotates from the first position 301 to the second position 302 by gravity, and the handle member 40 connected to the support member 30 through the connection wire 50 moves from the third position 401 to the fourth position 402.

The user performs the exercise by repeating a lifting operation of lifting and lowering the exercise member 20 while the support member 30 is at the second position 302.

Referring back to FIGS. 3 and 4, the exercise member 20 may rotate between a first exercise position 201 and a second exercise position 202 about the first axis 21. The first exercise position 201 may be a position when the exercise member 20 is at the maximum height, and the second exercise position 202 may be a position when the exercise member 20 is at the minimum height supported on the safety stopper 323.

Figure 9A:
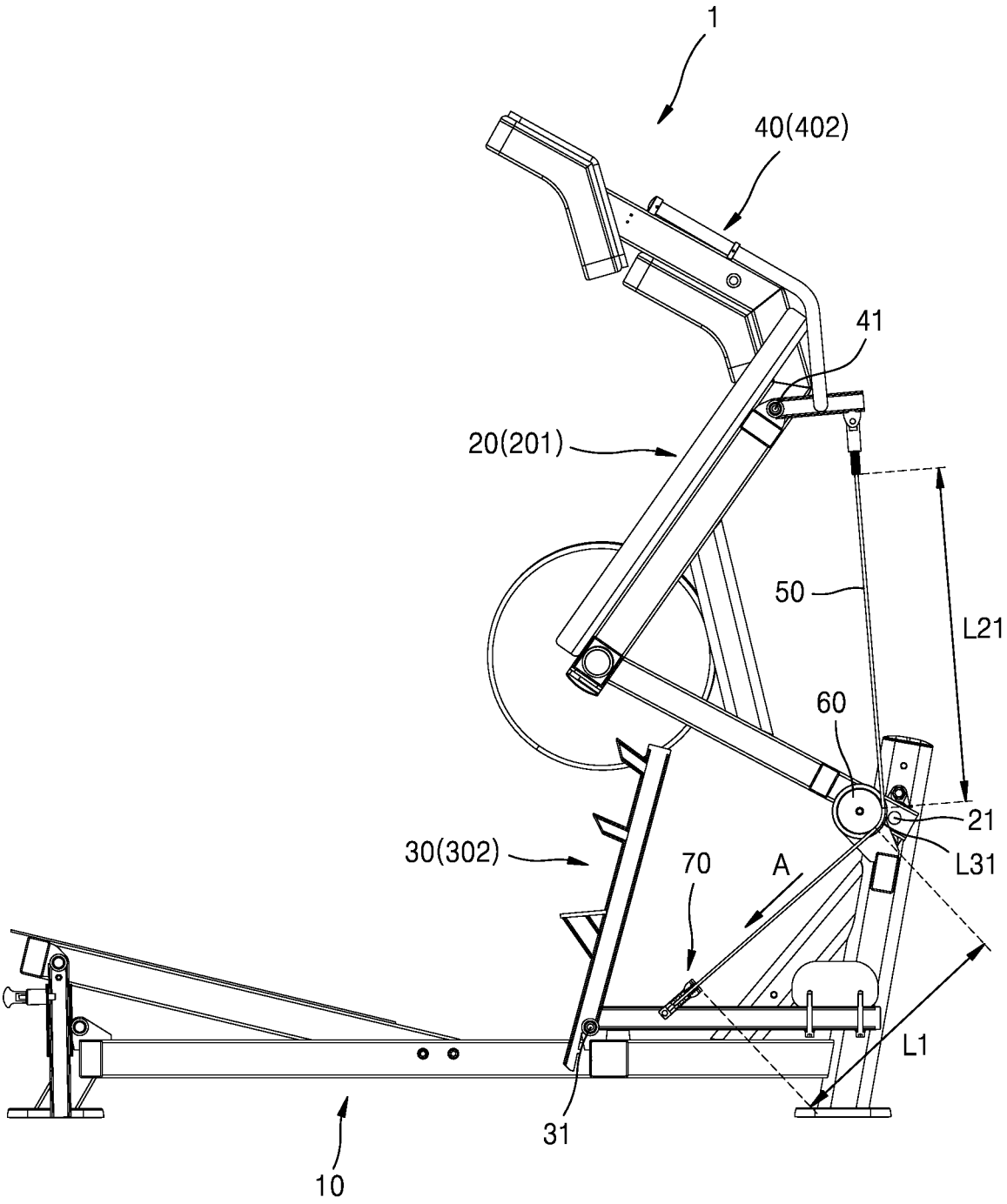
FIGS. 9A and 9B are views for explaining the movement of a handle member according to the rotation of an exercise member of a squat machine according to an embodiment.
Figure 9B:
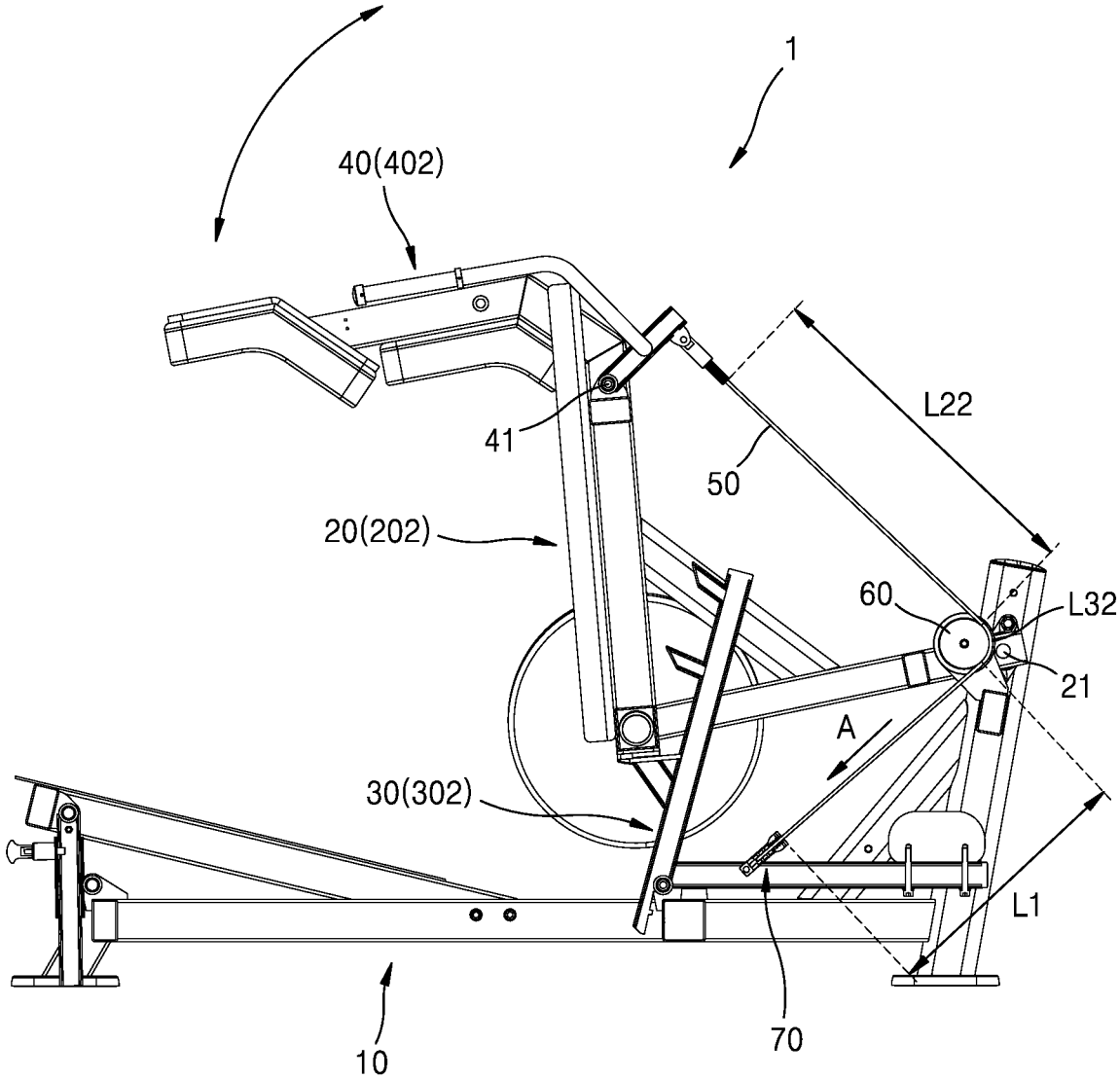

FIGS. 9A and 9B are views for explaining the movement of the handle member according to the rotation of the exercise member 20 of the squat machine 1 according to an embodiment.

Referring to FIGS. 9A and 9B, while the support member 30 is at the second position 302, when the exercise member 20 repeats a lifting operation in a range between the first exercise position 201 and the second exercise position 202, the handle member installed on the exercise member 20 lifts or lowers together with the exercise member 20.

When the support member 30 connected to the handle member 40 rotates due to the lifting or lowering of the handle member 40, the movement of the exercise member 20 may be unintentionally limited by the support member 30 or this may cause a user anxiety. When the handle member 40 unintentionally rotates about the third axis 41 during the lifting or lowering of the handle member 40, this may also cause the user anxiety.

In consideration of this point, when the user does not manipulate the handle member 40, the squat machine 1 according to an embodiment may be configured to prevent or minimize the unintentional rotation of the support member 30.

For example, the pulley 60 may be disposed on the base frame 10 such that the support member 30 is maintained at the second position 302 when the exercise member rotates about the base frame 10.

Because the exercise member 20 has a structure that rotates about the first axis 21, when the exercise member 20 rotates, the third axis 41 of the handle member 40 installed on the exercise member 20 also rotates about the first axis 21. When user is exercising, the handle member 40 moves while maintaining a constant distance from the first axis 21.

The pulley 60 may be disposed at a position spaced apart from the first axis 21 in the base frame 10. When the handle member 40 moves while maintaining the constant distance from the first axis 21, a distance from the pulley 60 to the handle member 40 changes.

In the case of a structure in which the support member 30 does not move while being located at the second position 302 when the exercise member 20 rotates, the length of the connection wire 50 from the support member 30 to the pulley 60 is constant. On the other hand, lengths L31 and L32 of the connection wire 50 wound around the pulley change according to a rotation angle of the exercise member 20, and distances L21 and L22 from the pulley 60 to the handle member 40 also change.

As described above, when the exercise member 20 rotates with respect to the base frame 10, the position of the pulley 60 may be determined in consideration of a change in the length of the connection wire 50 wound around the pulley 60.

Figure 10:
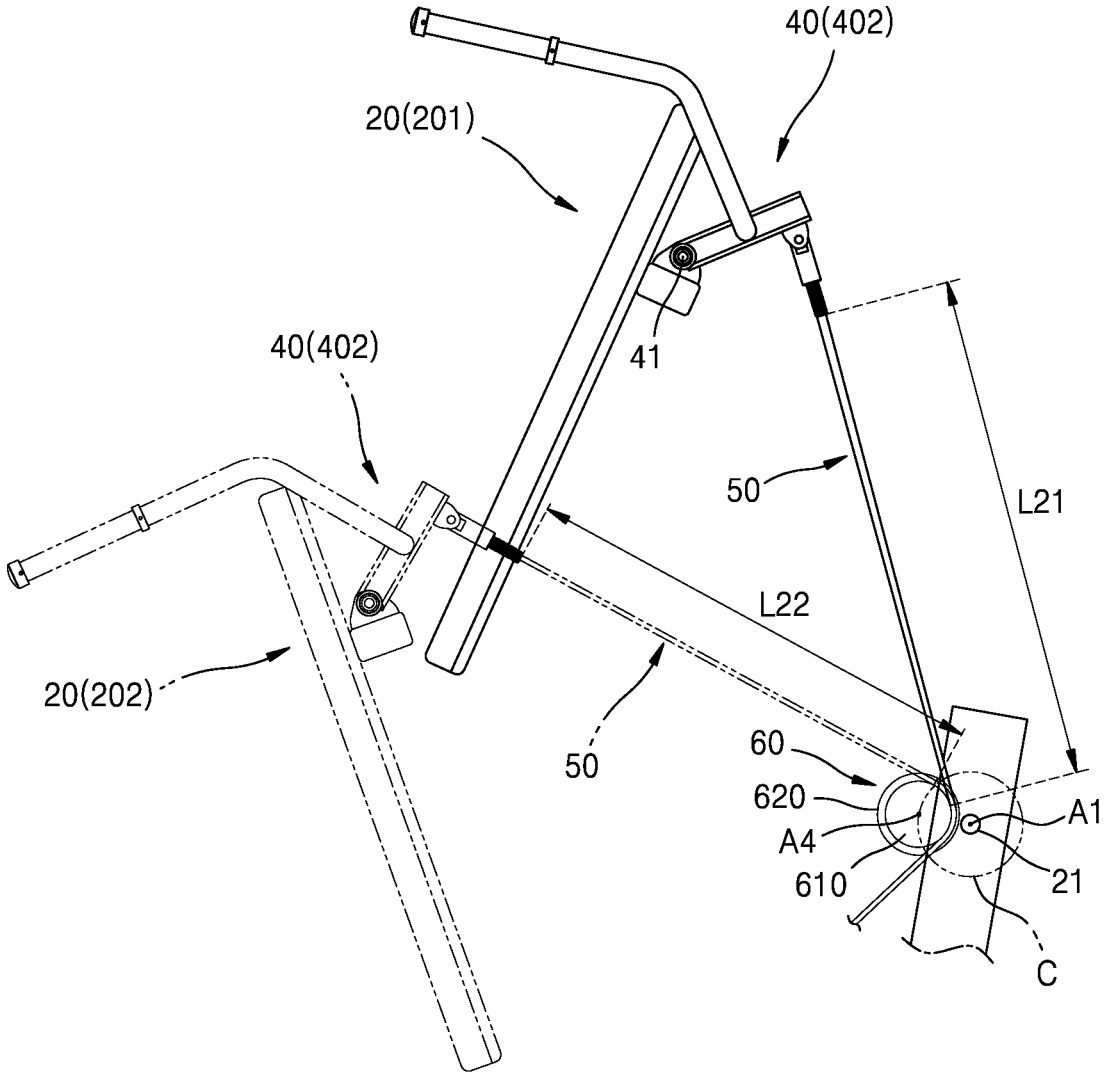
FIGS. 10 and 11 are views for explaining the arrangement of a pulley according to an embodiment.
Figure 11:
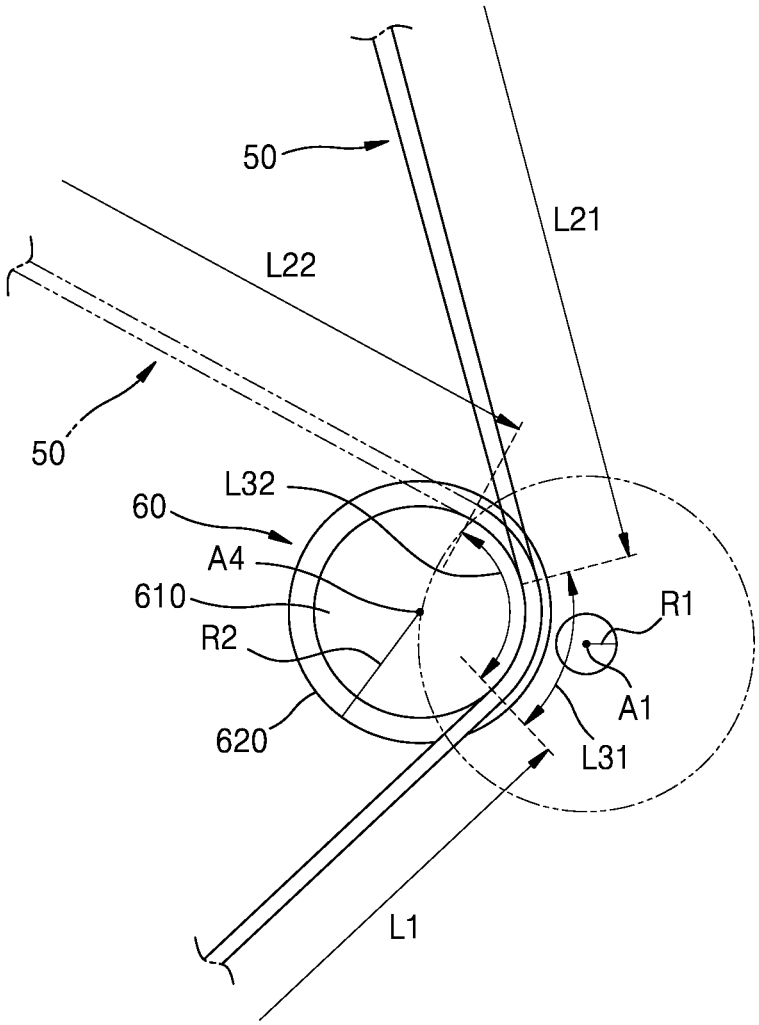

FIGS. 10 and 11 are views for explaining the arrangement of the pulley 60 according to an embodiment.

Referring to FIGS. 10 and 11, first, to reduce the lengths L31 and L32 of the connection wire 50 wound around the pulley 60, the pulley 60 may be considered as being located close to the first axis 21. For example, a center A4 of the pulley 60 may be considered as being arranged on a circumference C of an imaginary circle corresponding to a certain distance from the rotation center A1 of the first axis 21.

To minimize the lengths L31 and L32 of the connection wire 50 wound around the pulley 60 and smoothly rotate the pulley 60, a distance between the rotation center A1 of the first axis 21 and the center A4 of the pulley 60 may be greater than 1 time and less than 1.5 times the sum of a radius R2 of the pulley 60 and a radius R1 of the first axis 21.

Figure 12:
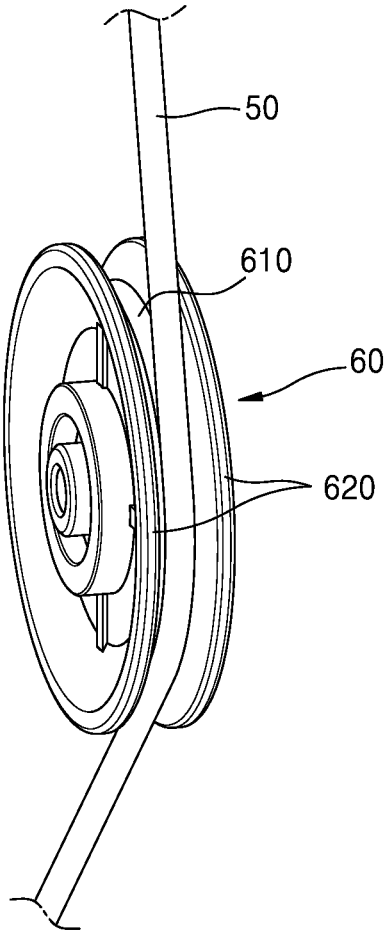
FIG. 12 is a diagram illustrating a pulley according to an embodiment.

FIG. 12 is a diagram illustrating the pulley 60 according to an embodiment. Referring to FIG. 12, the pulley 60 includes a contact part 610 contacting the connection wire 50 and wing parts 620 disposed on both sides of the contact part 610 and preventing shaking of the connection wire 50. The radius R2 of the pulley 60 may be the radius of the wing part 620 of the pulley 60.

Referring again to FIGS. 9A, 9B, 10 and 11, a length L1 of the connection wire 50 from the pulley 60 to the support member 30 is determined, and lengths L21+L31 and L22+L32, including a length wound around the pulley 60, of the connection wire 50 from the pulley 60 to the support member 30 are also determined. On the other hand, when the position of the handle member 40 moves as the exercise member 20 rotates, the lengths L31 and L32 of the connection wire 50 wound around the pulley 60 change. For example, the length L31 of the connection wire 50 wound around the pulley 60 when the exercise member 20 reaches the first exercise position 201 is smaller than the length L32 of the connection wire 50 wound around the pulley 60 when the exercise member 20 reaches the second exercise position 202. The first exercise position 201 may be a position when the exercise member 20 is at the highest position, and the second movement position 202 may be a position when the exercise member 20 is at the lowest position.

In consideration of this point, the pulley 60 may be disposed at a position at which the length L21 of the connection wire 50 from the pulley 60 to the handle member 40 when the exercise member 20 reaches the first exercise position 201 is greater than the length L22 of the connection wire 50 from the pulley 60 to the handle member 40 when the exercise member 20 reaches the second exercise position 202.

For example, the pulley 60 may be disposed at a position at which a difference (=L32-L31) between the length L31 of the connection wire 50 wound around the pulley 60 when the exercise member 20 reaches the first exercise position 201 and the length L32 of the connection wire 50 wound around the pulley 60 when the exercise member 20 reaches the second exercise position 202 is the same as a difference (=L21-L22) between the length L21 of the connection wire 50 from the pulley 60 to the handle member 40 when the exercise member 20 reaches the first exercise position 201 and the length L22 of the connection wire 50 from the pulley 60 to the handle member 40 when the exercise member 20 reaches the second exercise position 202.

When the exercise member 20 rotates with respect to the base frame 10 by setting the position of the pulley 60 as described above, shaking of the handle member 40 and the support member 30 may be reduced. For example, when the exercise member 20 rotates with respect to the base frame 10, rotation of the handle member 40 may be limited to within 20% of a rotatable range.

On the other hand, even if the arrangement of the pulley 60 is adjusted, due to a distance difference between the position at which the connection wire 50 is wound around the pulley 50 and the first axis 21, the length of the connection wire 50 from the pulley 60 to the handle member 40 changes while the exercise member 20 is lifting and lowering. Accordingly, in the exercise member 20 rotating about the first axis 21, the longest position at which the length of the connection wire 50 from the pulley 60 to the handle member 40 is longest and the shortest position at which the length of the connection wire 50 from the pulley 60 to the handle member 40 is shortest are present.

When the squat machine 1 is set, the connection wire 50 may be installed to fit when the exercise member 20 is located at the longest position. However, in the squat machine 1 set as described above, when the exercise member 20 moves to the shortest position, the connection wire 50 from the pulley 60 to the handle member 50 lengthens and loosens. This may cause the movement of the handle member 40, and in severe cases, the connection wire 50 may be separated from the pulley 60.

In consideration of this point, the squat machine 1 according to an embodiment may further include a bias member 70 disposed on at least one end of the connection wire 50 and providing a bias (or force) pulling the connection wire 50 in one direction A so as to maintain a certain tension even if the length of the connection wire 50 from the pulley 60 to the handle member 40 changes.

Figure 13:
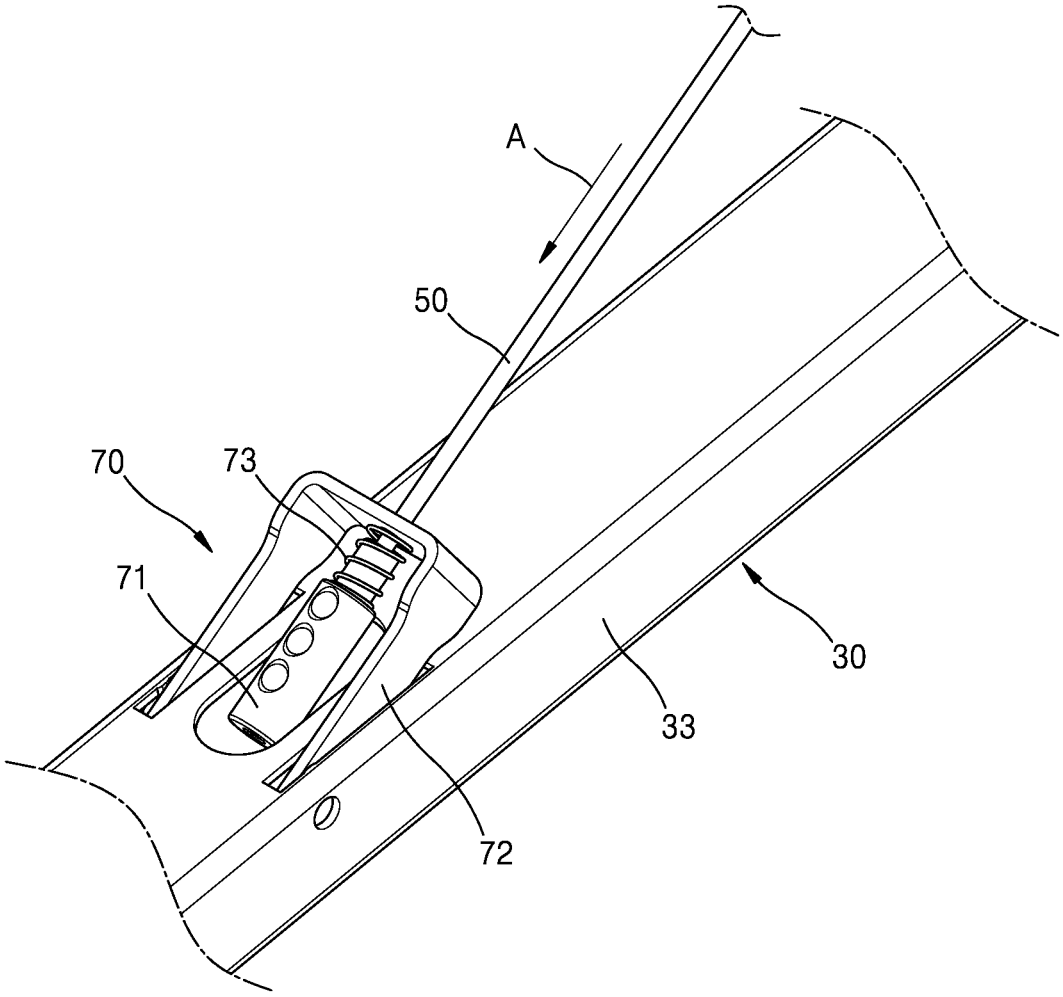
FIGS. 13 and 14 are views for explaining a bias member of a squat machine according to an embodiment.
Figure 14:
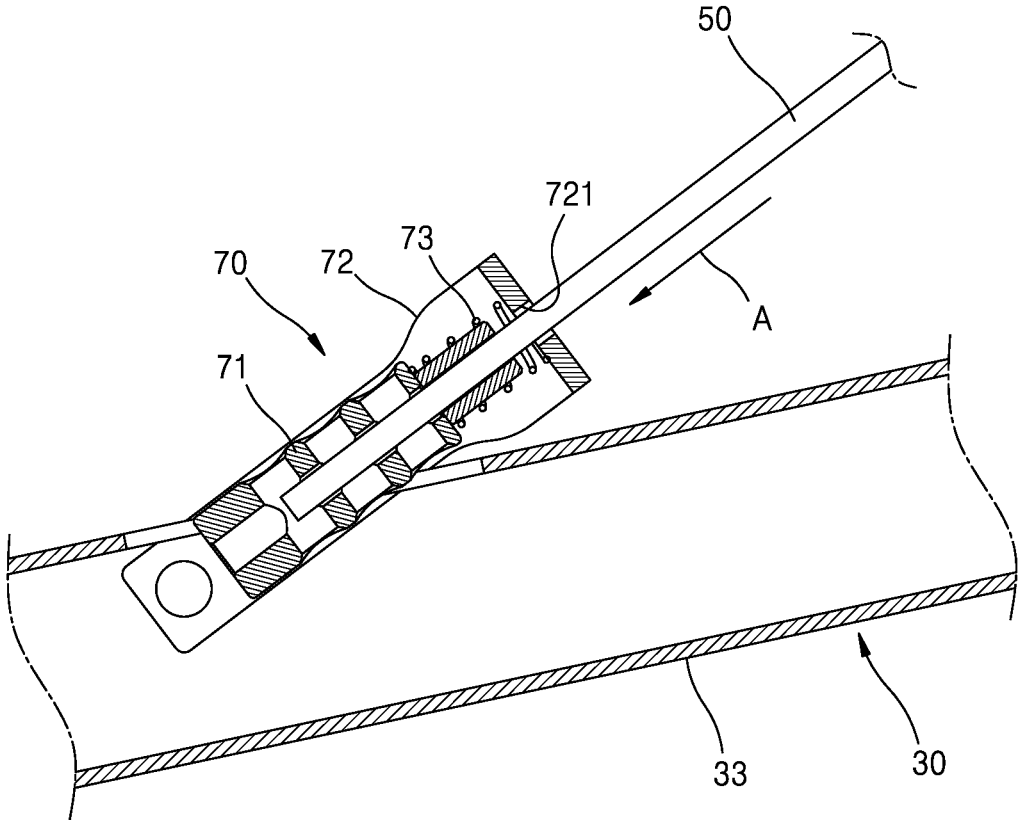

FIGS. 13 and 14 are views for explaining the bias member 70 of the squat machine 1 according to an embodiment. FIGS. 13 and 14 illustrate an example in which the bias member 70 is disposed on the support member 30, but the bias member 70 is not limited thereto, and may be disposed on the handle member 40.

Referring to FIGS. 13 and 14, one end of the connection wire 50 may be connected to the support member 30 by the bias member 70. One end of the connection wire 50 may be connected to the second part 33 of the support member 30 by the bias member 70.

In an embodiment, the bias member 70 may include a fixing portion 71 fixed to an end of the connection wire 50, a connection housing 72 connecting the connection wire to the support member 30, and an elastic member 73 providing an elastic force to move the fixing portion 71 away from the connection housing 72.

The connection housing 72 has an opening 721 through which the connection wire 50 passes, and has a structure rotatable to the second part 33 of the support member 30. The fixing portion 71 is fixed to the end of the connection wire 50 and is spaced apart from the opening 721 of the connection housing 72 by the elastic member 73. The fixing portion 71 is movable in the direction A until contacting the connection housing 72.

The connection wire 50 is in a state of being pulled in a direction closer to the support member 30 by the bias member 70. The connection wire 50 is in a state in which a tension is applied by the bias member 70 in a direction closer to the support member 30. Accordingly, even when the exercise member 20 is located at the shortest position, the connection wire 50 may not be loosened but may maintain the tension. In the above-described embodiment, an example in which the bias member 70 is disposed at a connection part of the support member 30 and the connection wire 50 has been described, but the bias member 70 is not limited thereto, and may be disposed at a connection part between the handle member 40 and the connection wire 50. In this case, the connection housing 72 may function as a component connected to the handle member 40.

A method of using the squat machine 1 according to the above-described embodiment is described.

Referring to FIG. 1, the squat machine 1 according to an embodiment may be in a state in which the exercise member 20 is supported by the support member 30 located at the first position 301. When the user performs an operation of standing up while supporting the shoulders on the shoulder support portions 23 of the exercise member 20, the exercise member 20 lifts, and a contact between the exercise member 20 and the support member 30 is released. The support member 30 rotates clockwise to move from the first position 301 to the second position 302.

When the user repeats a squat motion while supporting the exercise member 20, as shown in FIGS. 3 and 4, the exercise member 20 rotates about the first axis 21 and repeats lifting and lowering. When the exercise member 20 rotates about the first axis 21, the handle member 40 installed on the exercise member 20 rotates while maintaining a certain distance with respect to the first axis 21.

Even when the handle member 40 rotates by the pulley 60 spaced apart from the first axis 21, the support member 30 may maintain the second position 302. That is, while the exercise member 20 rotates with respect to the base frame 10 when the user is exercising, the support member 30 maintains the second position 302.

When the exercise member 20 rotates with respect to the base frame 10 while the support member 30 maintains the second position 302, the rotation of the handle member is limited. For example, when the exercise member 20 rotates with respect to the base frame 10 while the support member 30 maintains the second position 302, rotation of the handle member 40 is limited to within 20% of a rotatable range. Here, the rotatable range may be a range in which the handle member 40 rotates from the third position 401 to the fourth position 402.

When the user ends the exercise, the user manipulates the handle member 40 to rotate the handle member 40 about the third axis 41 from the fourth position 402 to the third position 401. Because the user manipulates the handle member 40 adjacent to a shoulder part by his/her hand, the user may rotate the handle member 40 while maintaining the balance of the lower body.

By manipulating the handle member 40, the support member 30 connected through the connection wire 50 rotates about the second axis 31 from the second position 302 to the first position 301. To support the exercise member 20 on the support member the user may rotate the handle member 40 while checking that the support member rotates from the second position 302 to the first position 301. That is, the user may manipulate the handle member 40 while visually checking the rotation of the support member 30 located below the exercise member 20 with the naked eye. Accordingly, the user may easily support the exercise member 20 on a desired portion of the first support portion 321 and the second support portion 322 of the support member 30.

The present disclosure has been particularly shown and described with reference to embodiments thereof. It will be understood by those of ordinary skill in the art that various changes in form and details may be made therein without departing from the spirit and scope of the present disclosure as defined by the appended claims. The disclosed embodiments should be considered in a descriptive sense only and not for purposes of limitation. Therefore, the scope of the present disclosure is defined not by the detailed description of the present disclosure but by the appended claims, and all differences within the scope will be construed as being included in the present disclosure.

The invention claimed is:

1. A squat machine comprising:

a base frame;

an exercise member which is rotatable about a first axis with respect to the base frame and capable of supporting at least one weight member;

a support member which is rotatable about a second axis, which is different from the first axis, with respect to the base frame and rotates between a first position located on a rotation path of the exercise member at which the exercise member is supportable and a second position out of the rotation path of the exercise member;

a handle member which is formed on the exercise member to rotate about a third axis, which is different from the first axis and the second axis, so that the support member is rotated to the first position;

a connection wire connecting the support member to the handle member; and a pulley guiding movement of the connection wire.

2. The squat machine of claim 1, wherein the pulley is disposed on the base frame such that the support member is maintained at the second position when the exercise member rotates with respect to the base frame.

3. The squat machine of claim 1, wherein rotation of the handle member is limited to within 20% of a rotatable range when the exercise member rotates with respect to the base frame while the support member is located at the second position.

4. The squat machine of claim 3, wherein the pulley includes a contact part contacting the connection wire, and wing parts disposed on both sides of the contact part and preventing shaking of the connection wire, and a distance between a rotation center of the pulley and a center of the first axis is greater than 1 and less than 1.5 times a sum of a radius of each of the wing parts and a radius of the first axis.

5. The squat machine of claim 3, wherein a length of the connection wire wound around the pulley changes when the exercise member rotates with respect to the base frame, and a position of the pulley with respect to the base frame is determined in consideration of a change in the length of the connection wire wound around the pulley.

6. The squat machine of claim 3, wherein the third axis of the handle member moves with respect to the first axis when the exercise member rotates with respect to the base frame, and a distance from the pulley to the handle member changes while the third axis moves.

7. The squat machine of claim 1, wherein the exercise member includes shoulder support portions configured to contact user's shoulders, and the handle member is disposed adjacent to each of the shoulder support portions.

8. The squat machine of claim 7, wherein a shortest distance between the handle member and each of the shoulder support portions is within 20 cm.

9. The squat machine of claim 1, wherein the support member is disposed lower than the exercise member when the support member is at the first position.

10. The squat machine of claim 1, wherein the support member includes a first support portion supporting the exercise member at a first height; and a second support portion supporting the exercise member at a second height lower than the first height.

11. The squat machine of claim 1, wherein the support member includes a safety stopper supporting the exercise member to prevent the exercise member from directly contacting a floor at the second position.

12. The squat machine of claim 1, wherein the support member is configured to move from the first position to the second position by gravity.

13. The squat machine of claim 12, wherein the support member further includes a weight portion providing a load to move from the first position to the second position.

14. The squat machine of claim 1, further comprising: a bias member disposed on at least one end of the connection wire and providing a bias pulling the connection wire in one direction.

15. The squat machine of claim 14, wherein the bias member includes a fixing portion fixed to an end of the connection wire;

a connection housing connecting the connection wire to the support member or the handle member; and an elastic member providing an elastic force to move the fixing portion away from the connection housing.

* * * * *